US005348469A

United States Patent [19]

Sestrap

[11] Patent Number: 5,348,469

[45] Date of Patent: Sep. 20, 1994

[54] AIR, PROPANE AND OXYGEN BURNER WITH NO EXIT FLAME

[75] Inventor: Arv M. Sestrap, Calgary, Canada

[73] Assignee: Sharjan Limited, Whiterock, Canada

[21] Appl. No.: 7,760

[22] Filed: Jan. 22, 1993

[51] Int. Cl.[5] ..... F23D 14/62

[52] U.S. Cl. ..... 431/353; 431/354

[58] Field of Search ..... 431/354, 353, 351

[56] References Cited

U.S. PATENT DOCUMENTS 2,510,432 6/1950 Scharbau ..... 431/353

3,558,253 1/1971 Smith et al. ..... 431/353

*Primary Examiner*—Carroll B. Dority

[57] ABSTRACT

A hot air burner in which a nozzle assembly is comprised of an inlet port housing (8) incorporating an internal plenum chamber (18) into which is introduced a flow of compressed air via an inlet port (4) in the inlet housing (8). The flow of compressed air is controlled by the width of an adjustable gap created between a frusto-conical exterior surface (20) of the internal annular chamber (18) and the internally chamfered wall (22) of a mixing tube (12). Turbulence in the compressed air-flow is created as the air enters the mixing tube (12) and this swirling effect promotes efficient mixing of subsequently introduced combustible gases to tile mixing tube (12) via an inlet port (6) in the inlet housing (8). The combustible mixture is ignited and the resultant combustion contained within the confines of an outer burner tube (10). The flame front is contained within the burner tube (10) and extends approximately six inches into the length of the tube (10). The high temperature exhaust gases are carried to the exit opening of the burner tube (10) by the continuous flow of compressed air and thus available, flame free, for application.

3 Claims, 3 Drawing Sheets

AIR, PROPANE AND OXYGEN BURNER WITH NO EXIT FLAME

BACKGROUND—FIELD OF INVENTION

This invention relates to hot air lances, more specifically to tile provision of a flame free burner nozzle assembly.

BACKGROUND—DESCRIPTION OF PRIOR ART

The use of a moving stream of hot air to dry moisture laden objects is, of course, a concept well known and well understood and much inventive activity has been applied to the development of devices whereby such a stream of hot air can be easily and sufficiently generated.

One area of particular interest to inventors over the years has been the need to develop a directed source of high temperature air flow for use in the removal of moisture and softening of peripheral material prior to the refilling, or patching, of potholes in asphalt paving.

While the devices thus developed, varied significantly in both shape and size they all nevertheless, essentially functioned by mixing combustible gases, igniting the mixture, and utilizing the resultant exhaust gas flow as a directed heat source.

Not surprisingly, then, the patent literature is replete with descriptions of such devices; examples of which may be found in U.S. Pat. Nos. 2, 107,365 which issued to Bray in 1938, 3,156,454 which issued to Flynn in 1964, 3,851,050 which issued to Groenendaal et al in 1974, 4,082,497 which issued to Crawford et al in 1978, 4,408,984 which issued to Forster in 1983, 4,416,613 which issued to Yagisawa in 1984, 4,462,795 which issued tel Vosper et al in 1984 and 4,585,409 which issued to Pryor in 1986.

Further improvements to the basic theme may also be found in U.S. Pat. No. 4,798,530 issued to the inventor of the present invention in 1989 and wherein is disclosed a nozzle assembly for a hot air torch.

It will be appreciated that all of the above cited literature discloses devices which range in performance from relatively inefficient to moderately efficient. All, however, suffer from one or more shortcomings including some or all of the following; substantially uncontrollatable burn rates and temperatures, high exhaust noise levels and relatively complicated mixture control mechanisms.

While it is true that all of the above listed shortcomings are, to some extent, obviated by the device disclosed in this inventor's U.S. Pat. No. 4,798,530 it is nevertheless fair to say that all heretobefore known devices suffer from the following disadvantages:

(a) they provide a burn the rate and temperature of which is relatively difficult to control;
(b) the control of gas mixture is complex and difficult to properly master;
(c) intake gas pressures are relatively high, requiring appropriate equipment;
(d) exhaust gas noise levels are uncomfortably high; and
(e) they require a moderately high level of operator skill to avoid personal injury.

OBJECTS AND ADVANTAGES

Accordingly, besides the objects and advantages of the device presented in my above named patent, several objects and advantages of the present invention are:

(a) to provide a no exit flame hot air burner the burn rate and temperature of which is simple to control;
(b) to provide a no exit flame hot air burner wherein achieving the correct inlet gas mixture is a relatively simple process;
(c) to provide a no exit flame hot air burner wherein exhaust noise levels are significantly reduced; and
(d) to provide a no exit flame hot air burner wherein the safety of the operator is significantly enhanced.
(e) to provide a no exit flame hot air burner with the facility to adjust ratio of air to gas on assembly for air volume and pressure.

Further objects and advantages are to provide a no exit flame hot air burner the applications of which are not limited to the repair of patholes but which possesses a level of versatility sufficient to permit its ready adaptation to alternate applications. Still further objects and advantages will become apparent from a consideration of the ensuing drawings and description.

DRAWING FIGURES

Figure 1:
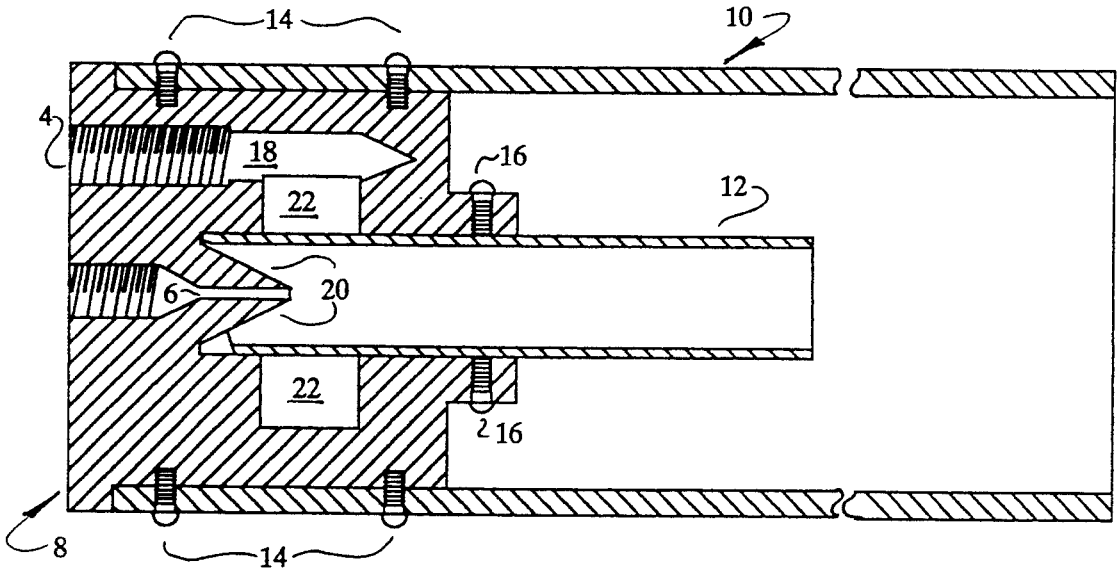
FIG. 1 is a sectional side view of the nozzle and burner assembly showing the relative positioning of the various components.
Figure 2:
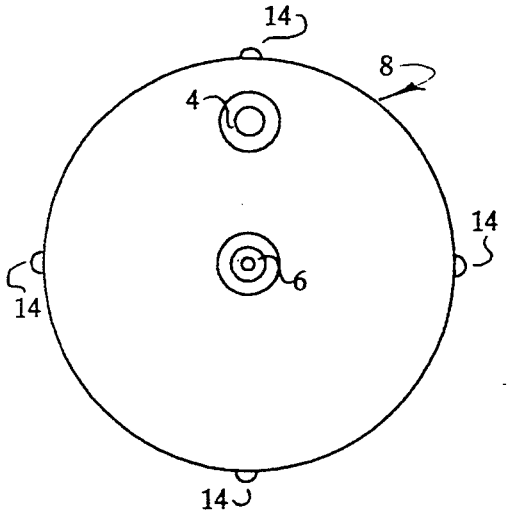
FIG. 2 is an end on view of the top surface of the nozzle and burner assembly showing the relative positioning of the inlet gas port and compressed air inlet port.
Figure 2A:
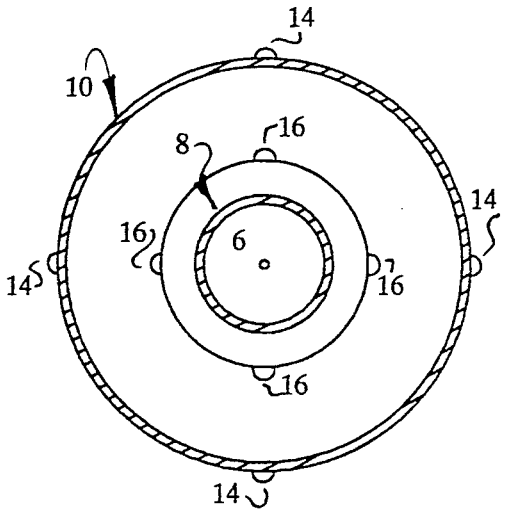
Figure 3:
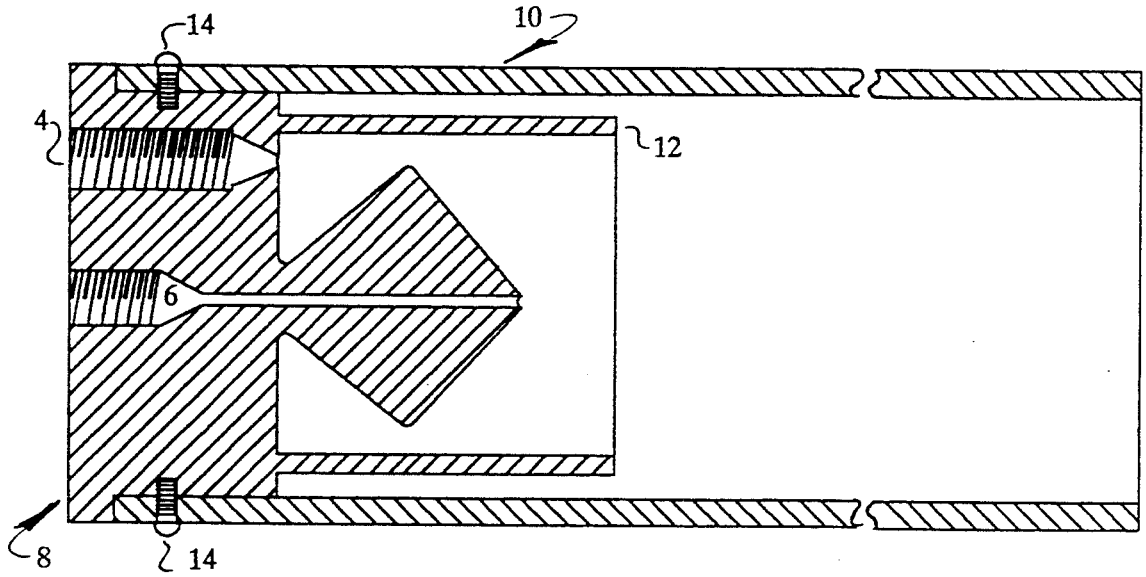
FIG. 3 is an end on view of the lower, exhaust port of the nozzle and burner showing the relative positioning of the various components.

NUMERALS USED IN THE DRAWINGS compressed air inlet port 06 oxygen & propane inlet
08 inlet housing 10 burner tube
12 mixing tube 14 Burner tube set screws
16 mixing tube set screws 18 air flow chamber
20 frusto-conical surface 22 air flow constriction

DESCRIPTION—FIGURES 1 TO 3

A typical embodiment of the device of the present invention is illustrated having reference to the above mentioned FIGURES and, in essence, is an improvement on the device disclosed in my U.S. Pat. No. 4,798,530.

The no exit flame hot air burner is comprised of a generally circular body section 8 having a pair of radially decreasing steps such that each step is of smaller diameter than the preceeding step and each step incorporates circumferentially, at least three drilled and tapped holes with screw thread dimensions sufficient to accommodate the insertion of standard machine screws. The body section 8 further incorporates, at the smallest diameter stepped end, an axial bore; which bore extends part way into the body section and is radially enlarged over part of its length to form a plenum chamber 18 within the body section 8.

The innermost surface of the plenum chamber 18, i.e., the surface furthest removed from the end of the enlarged bore is frusto-conical in shape 20 with a wall slope of substantially 45 degrees and wherein the apex is axially centered with the bore.

The opposite end of the body section 8 incorporates a pair of drilled and partially threaded passageways, 4 and 6 respectively, one of which passageways 4 serves as an inlet port for a source of compressed air (not shown) and is located toward the circumference of the body section 8 and extends axially into the body section 8 for a distance sufficient to bring an end of the passageway into open communication with the plenum chamber 18.

The second passageway 6 serves as an inlet port for a source of premixed combustible gases (not shown) and is located centrally on the body section 8, extends axially part way into the body section 8 and is radially diminished over part of its length to form a small diameter orifice, which orifice extends through the frusto-conical inner surface 20 of the plenum 18 and into open communication with the plenum chamber 18.

A hollow, rigid mixing tube 12 approximately two and one half inches in length and incorporating an internal wall chamfer of approximately forty five degrees at one end, is slidably inserted into the axial bore of the body section 8 such that the internally chamfered end of the mixing tube is brought into close proximity with the frusto-conical 22 inner surface of the plenum chamber 18, thus creating a small gap 22 between the frusto-conical 20 surface and the end of the mixing tube 12; the size of which gap 22 is adjustable by moving the mixing tube 12 before and aft within the body section 8 bore and fixable by clamping the mixing tube 12 within the body section 8 bore using machine screws 16 threaded through the smallest diameter step of the body section 8 and into abutment with the outer surface of the mixing tube 12.

An elongate, rigid outer burner tube 10 having at one end at least three circumferentially arranged through holes is slidably inserted over the second step of the body section 8 and secured in place by the insetion of machine screws 14 through the burner tube 10 through holes and into the threaded holes of the second step on the body section 8.

A source of at least two premixed combustible gases such as oxygen and propane is coupled by conventional means such as pipe fittings to the combustible gas inlet port 6. A source of compressed air is coupled by conventional means such as pipe fittings to the compressed air inlet port 4. Combustible gases are introduced at low pressure (approximately 10 PSI) into the mouth of the mixing tube 12 via inlet port 6. Concurrently, compressed air at between 25 and 50 PSI is introduced into the plenum chamber 18 via inlet port 4. The Plenum chamber 18 shape imparts a swirling action to the compressed air flow which flows past the gap 22 between the mixing tube 12 end and the frusto-conical 20 inner surface and into the mixing tube 12. Propane, by its nature heavier than air, tends to collect in the lower portions of the mixing tube 12 where it is collected by the swirling action of the compressed air and more thoroughly mixed with the oxygen. The resultant mixture of oxygen, propane and compressed air is ignited by any appropriate and conventional means as it exits the mixing tube 12.

The resultant flame front propagates rapidly and evenly, rendering a complete and efficient burn which extends for approximately six inches beyond the end of the mixing tube 12. It will be understood that the outer burner tube 10 is of a length appropriate to the particular application, but, in all cases will be such that only the exhaust gases, swept forward by the compressed air flow emerge at the "working" end of the burner tube 10.

Accordingly the reader will see that the flame free hot air lance of the present invention can be constructed with a variety of external configurations without departure from the basic nozzle structure as described herein and, therefore, can be readily adaptable to a wide range of applications requiring the use of a directed, powerful flow of hot air capable of reaching temperatures of 1800 degrees Fahrenheit. Furthermore the flame free hot air lance of the present invention has the additional advantages in that

- it is of relatively simple construction;
- it requires little maintenance;
- it provides efficient and substantially complete combustion;
- it is relatively quiet compared to prior art devices; and
- it places few demands on the technical skills of the operator.

Although the description herein contains many specificities, these should not be construed as limiting the scope of the present invention but as merely providing an illustration of the presently preferred embodiment of the invention. For example, the burner tube need not be round, or located to the inlet housing in the manner illustrated. Likewise, the method of adjusting the positioning of the mixing tube relative to the air flow chamber may be by any convenient means other that those shown.

Thus the scope of the invention should be determined by the appended claims and their legal equivalents, rather than by the examples provided.

I claim:

1. An apparatus for the delivery of a directed stream of flame free hot air to a work site comprising:

a body section having at one end an axial bore, the bore radially enlarged along part of its length to form a plenum chamber the innermost surface of which is frusto-conical;

mixing tube means sidably insertable into said axial bore and adjustable lengthwise therein so that a gap between an end of said mixing tube means and said frusto-conical surface may be set to predetermined distances;

means for locking said mixing tube means within the confines of said axial bore;

means for directing a stream of at least two combustible gases through said frusto-conical surface and into said end of said mixing tube means;

means for directing a stream of compressed air into said plenum chamber wherein said stream of compressed air is imparted with swirl before flowing into said end of said mixing tube means via said gap between said mixing tube means and said frusto-conical surface;

means for igniting the total mixture of said premix of combustible gases and said compressed air as said total mixture exits the other end of said mixing tube means; and outer burner tube means removably insertable at one end over said body section and secured thereon so that the heat generated by the combustion of said total mixture is conveyed through the bore of said outer burner tube and exits at the other end of said outer burner tube means.

2. The apparatus of claim 1 wherein said means for directing a stream of at least two combustible gases is comprised of a partially threaded bore coaxial with said body section, the bore radially diminishing for part of its length to form a small diameter orifice which extends through said frusto-conical surface and into said plenum chamber.

3. The apparatus of claim 1 wherein said means for directing a stream of compressed air into said plenum chamber is comprised of a partially threaded axial bore located toward the circumference of said body section and extending through said body section and into said plenum chamber.

* * * * *